US010695771B2

(12) United States Patent
Friz

(10) Patent No.: US 10,695,771 B2
(45) Date of Patent: Jun. 30, 2020

(54) DEVICE FOR SHREDDING MATERIAL, IN PARTICULAR MEDICAL WASTE MATERIAL

(71) Applicant: WEIMA Maschinenbau GmbH, Ilsfeld (DE)

(72) Inventor: Martin Friz, Stuttgart (DE)

(73) Assignee: WEIMA MASCHINENBAU GMBH, Ilsfeld (DE)

( * ) Notice: Subject to any disclaimer, the term of this patent is extended or adjusted under 35 U.S.C. 154(b) by 829 days.

(21) Appl. No.: 15/083,599

(22) Filed: Mar. 29, 2016

(65) Prior Publication Data

US 2016/0288133 A1 Oct. 6, 2016

(30) Foreign Application Priority Data

Mar. 30, 2015 (DE) ..... 10 2015 003 991

(51) Int. Cl.

| | |
|---|---|
| ***B02C 18/00*** | (2006.01) |
| ***B02C 18/14*** | (2006.01) |
| ***B02C 18/08*** | (2006.01) |
| ***B02C 18/22*** | (2006.01) |
| ***B02C 19/00*** | (2006.01) |

(Continued)

(52) U.S. Cl.

CPC ..... *B02C 18/2275* (2013.01); *B02C 18/0084* (2013.01); *B02C 18/08* (2013.01); *B02C 18/145* (2013.01); *B02C 18/2233* (2013.01); *B02C 19/0075* (2013.01); *B02C 2018/168* (2013.01); *B02C 2018/188* (2013.01)

(58) Field of Classification Search

CPC ..... B02C 18/2275; B02C 18/0084; B02C 19/0075; B02C 18/2233

USPC ..... 241/222, 224, 225, 243, 242, 280–282; 99/286, 546, 553, 564–566, 574–576, 99/593–599, 617, 621

See application file for complete search history.

(56) References Cited

U.S. PATENT DOCUMENTS 2,514,111 A * 7/1950 Gilmore ..... B02C 13/26 241/186.3
2,879,951 A * 3/1959 Ulke ..... F25C 5/046 241/185.5

(Continued)

FOREIGN PATENT DOCUMENTS

CA 2121539 A1 10/1994
DE 1298867 B 7/1969

(Continued)

*Primary Examiner* — Sean M Michalski
(74) *Attorney, Agent, or Firm* — Lucas & Mercanti, LLP; Klaus P. Stoffel

(57) ABSTRACT

A device for shredding material has a shredding rotor, which revolves about an axis of rotation and supports at least one blade, and a first counter-blade which cooperates with the blade of the shredding rotor. A feed plate is provided here, which is mounted to be rotatable about a pivot axis and which is connected to an actuator, in particular to an electric motor, so that, with the aid of the actuator, the feed plate can be brought into a feed position, in which the material to be shredded can lie on a first main surface of the feed plate and can slide along this in the direction of the shredding rotor, and into a first pressing position in which the material to be shredded is likewise pressed with the first main surface of the feed plate against the shredding rotor and shredded between the blade and the first counter-blade.

11 Claims, 4 Drawing Sheets

(51) Int. Cl.
*B02C 18/16* (2006.01)
*B02C 18/18* (2006.01)

(56) References Cited

U.S. PATENT DOCUMENTS 3,750,966 A * 8/1973 Anderson ..... A61M 5/3278 241/100
4,127,236 A 11/1978 Lasar
4,423,844 A * 1/1984 Sours ..... B02C 18/0084 241/236
4,579,028 A * 4/1986 Neidhardt ..... B26D 3/18 83/109
4,905,919 A * 3/1990 Okazaki ..... B02C 18/0084 241/160
5,076,429 A * 12/1991 Patrick ..... B65F 1/1607 206/366
5,125,565 A 6/1992 Rogers
5,195,685 A * 3/1993 Dumaine ..... B02C 18/186 241/242
5,205,495 A * 4/1993 Garnier ..... B02C 18/0084 241/159
5,213,272 A * 5/1993 Gallagher ..... B02C 18/0084 241/33
5,248,100 A * 9/1993 Arakawa ..... B02C 18/142 241/34
5,595,348 A * 1/1997 Barone ..... B02C 18/0084 100/217
5,775,608 A * 7/1998 Dumaine ..... B02C 18/146 241/242
5,971,305 A * 10/1999 Davenport ..... B02C 18/0084 241/197
5,988,541 A * 11/1999 Barone ..... B02C 18/0084 241/100
6,126,100 A * 10/2000 Barth ..... B02C 18/145 241/243
6,308,905 B1 * 10/2001 Balvanz ..... B02C 13/2804 241/101.761
7,926,753 B2 * 4/2011 Carver ..... B02C 18/0007 241/224
8,201,764 B2 * 6/2012 Pallmann ..... B02C 18/16 241/167
8,348,189 B2 * 1/2013 Kusters ..... B02C 18/0007 241/222
8,393,562 B1 * 3/2013 Dunstan ..... B02C 18/142 241/100
8,590,820 B2 * 11/2013 Taylor ..... B02C 19/0075 241/100
8,733,682 B2 * 5/2014 Schiffer ..... B02C 18/0084 241/224
9,221,612 B2 * 12/2015 Strautmann ..... B02C 18/2275
2003/0168367 A1 * 9/2003 Pike ..... A61M 5/3205 206/366
2005/0269320 A1 * 12/2005 Erickson ..... A61M 5/3205 220/4.21
2009/0039183 A1 * 2/2009 Wakeman ..... B02C 19/0075 241/2
2013/0032651 A1 * 2/2013 Taylor ..... B02C 18/0084 241/36
2013/0284837 A1 * 10/2013 Cochran ..... B02C 18/2275 241/101.5
2013/0299318 A1 * 11/2013 Strautmann ..... B02C 18/2275 198/736
2015/0158030 A1 * 6/2015 Lindner ..... B02C 13/282 241/280
2015/0231637 A1 * 8/2015 Ali ..... B02C 18/0084 241/47
2015/0273476 A1 * 10/2015 Jackson ..... B02C 23/08 241/36
2017/0114309 A1 * 4/2017 Hammond ..... C11D 13/30
2018/0214885 A1 * 8/2018 Garin Rotondaro ..... C04B 18/021
2018/0345293 A1 * 12/2018 Venturi ..... B02C 18/2233

FOREIGN PATENT DOCUMENTS

DE 9305837 U1 8/1993
DE 20011402 U1 9/2000
DE 202009012155 U1 1/2011
EP 1048353 A1 11/2000
EP 3015750 A2 5/2016
JP H08290075 A 11/1996
WO 2004071567 A1 8/2004
WO 2007086040 A2 8/2007
WO 2010094306 A1 8/2010
WO 2011092588 A1 8/2011

* cited by examiner

DEVICE FOR SHREDDING MATERIAL, IN PARTICULAR MEDICAL WASTE MATERIAL

CROSS-REFERENCE TO RELATED APPLICATIONS

The present application claims priority of DE 10 2015 003 991.1, filed Mar. 30, 2015, the priority of this application is hereby claimed and this application is incorporated herein by reference.

BACKGROUND OF THE INVENTION

1. Field of the Invention

The invention relates to a device for shredding material, in particular medical waste material, having a) a shredding rotor, which revolves about an axis of rotation and supports at least one blade, and having b) a first counter-blade, which cooperates with the blade of the shredding rotor.

2. Description of the Prior Art

Shredding devices of this type are known as large-volume shredding machines with powerful drives for the shredding rotor and are used for example in the timber industry or the waste management industry.

Various methods have been developed for these shredding machines with regard to advancing the material to be shredded towards the shredding rotor or bringing it between the blade and the counter-blade.

Therefore, DE 200 11 402 U1, for example, discloses a shredding machine in which a slide can be displaced over a cylindrically curved base and pushes the material to be shredded against the rotor.

EP 1 048 353 A1 further discloses a shredding machine with a feed wall which is mounted in stationary manner in a housing and adjoins a loading window on the housing with its upper edge. The feed wall is set at an angle in such a way that material to be shredded which is fed through the loading window slides downwards on its surface. At the lower edge of the feed wall, the material to be shredded is fed to a plunger, which presses it against the circumferential surface of a shredding rotor.

Previously known shredding machines are disadvantageous in that it is difficult to meter the feed of material to be shredded to the rotor.

SUMMARY OF THE INVENTION

The object of the invention is to provide a shredding device which is more flexible with regard to the feed of material to be shredded.

This object is achieved with a device of the type mentioned at the outset, in which c) a feed plate is provided, which is mounted such that it is rotatable about a pivot axis and which is connected to an actuator, in particular to an electric motor, in such a way that the position of the feed plate about the pivot axis can be varied with the aid of the actuator, and in that d) the pivot axis of the feed plate is arranged with respect to the axis of rotation of the shredding rotor such that with the aid of the actuator, the feed plate can be brought into a feed position in which the material to be shredded can lie on a first main surface of the feed plate and slide along this in the direction of the shredding rotor, and in that with the aid of the actuator, the feed plate can be brought into a first pressing position, in which the material to be shredded is likewise pressed with the first main surface of the feed plate against the shredding rotor and is shredded between the blade and the first counter-blade.

The inventors have recognised that, particularly in smaller shredding machines which are designed for drive motors with lower nominal powers, the metering of the feed of material needs to be improved over that of the previous feed methods. Otherwise too much material would arrive at once between the blade and the counter-blade, thereby increasing the power input of the drive motor of the shredding rotor. Moreover, there is an increased risk with smaller shredding machines that the shredding rotor will become blocked if too much material is fed in at once.

This presents a particular problem if, as in the exemplary embodiments explained further below, the shredding machine is a shredding machine with which medical waste in hospitals is to be shredded in the immediate vicinity of patient rooms and operating areas. This is because there is generally only a 230 volt single-phase current supply available there, which means that the maximum power of the drive motor is approximately 3.5 kW. Alternatively, the device according to the invention can also be supplied with 400 V and have a drive power of 5.5 kW. Pure electric motors as well as hydraulic motors are both conceivable here as drive motors. Further fields of use which may be considered for the device according to the invention are, for example, the shredding of food waste or information carriers (paper files, electronic data carriers etc.).

The invention is based on the knowledge that, when the feed plate of a shredding device is rotatably mounted and its position is controllable, it can assume more functions within the shredding device.

On the one hand, the feed plate can be used as a chute with a variable inclination, through which it is possible to control the feed of material in the direction of the shredding rotor. On the other hand, the feed plate can be used as a pressing mechanism so that the material to be shredded can be captured by the shredding rotor as quickly as possible. It is thus possible to achieve an economical construction and operation of the device through the integration of both functions in a single component.

A decisive factor, therefore, is that it is possible to pivot the feed plate over its pivot axis with respect to the shredding rotor.

The term feed plate does not necessarily refer to a plane-parallel plate here. Rather, it refers to a component which has at least one main surface on which the material to be shredded can slide in the direction of the shredding rotor. In particular, the feed plate can also be adapted in terms of its geometry to the circumference of the shredding rotor.

In general, the axis of rotation of the shredding rotor and the pivot axis of the feed plate will be arranged parallel to one another.

It is advantageous if, in the feed position, the inclination of the first main surface of the feed plate with respect to the horizontal is variable at least in the range of circa 15° to 25°, preferably 10° to 45°, still more preferably 5° to 85°. The rate at which the material to be shredded is fed to the shredding rotor can thereby be readily controlled in continuously variable manner and according to requirements. In particular, by selecting smaller inclinations, the feed of material to the shredding rotor can be stopped completely.

For energy-efficient shredding of the material in as short a time as possible or for freeing blockages of the shredding rotor, provision can be made for the shredding rotor to be operable in both directions of rotation.

To this end, provision can be made in particular for the axis of rotation of the shredding rotor and the pivot axis of the feed plate to define a plane which divides the device into two sub-regions and for the first counter-blade to be located in the first sub-region and a second counter-blade to be located in the second sub-region. It can be particularly advantageous if the plane forms an acute angle with the vertical. The asymmetrical geometry of the cutting space results in a different cutting behaviour of the device in the two directions of rotation.

The feed plate can furthermore be mounted at one end such that it is rotatable about the pivot axis. This results in a greater effective length of the main surface of the feed plate with which it presses the material to be shredded against the shredding rotor. As large as possible a passageway for the medical waste material is moreover produced in this way between the pivot axis and the housing of the device in the plane of the feed plate.

So that the material can be shredded efficiently, a passageway of this type can also be advantageous between the pivot axis and the surface of the shredding rotor. Concrete provision can be made for the axis of rotation of the shredding rotor and the pivot axis of the feed plate to be spaced from one another in such a way that, upon a change in the direction of rotation of the shredding rotor, the material to be shredded can be fed to the second counter-blade. In this case, the material to be shredded arrives in the second sub-region of the device through the passageway created. To transfer the material more easily here, it can moreover be expedient for the feed plate to be brought into an intermediate position so that, together with the shredding rotor, it forms a type of funnel which guides the material to be shredded.

It can be further advantageous if, upon a change in the direction of rotation of the shredding rotor, the feed plate can be brought into a second pressing position in which the material to be shredded is pressed with a second main surface of the feed plate against the shredding rotor and is shredded between the blade and the second counter-blade. To this end, the feed plate, starting from the first pressing position or from the intermediate position, is rotated about its pivot axis in the opposite direction. The feed plate can therefore be used as a type of "flipper" for executing the pressing action upon a rotation of the shredding rotor in one or the other direction of rotation.

To increase the shredding capacity and ensure different cutting geometries, provision can be made for a cutting geometry to be provided at the second counter-blade which is different from that at the first counter-blade, in particular by arranging the second counter-blade such that it is not radial to the shredding rotor.

Provision can furthermore be made for the feed plate to have a pivoting range of at least 200°, in particular at least 270°, about the pivot axis. A large pivoting range of the feed plate is associated with a large spacing between the pivot axis and the shredding rotor. On the one hand, this enables a large circumferential region of the shredding rotor to be used. On the other hand, the relatively large volume between the feed plate and the shredding rotor enables a larger quantity of material to be shredded to be fed to the device at once.

To control the device, a control means can be provided which controls the actuator of the feed plate and the shredding rotor in such a way that the power input of the shredding rotor does not exceed the maximum power specification. To this end, the control means can vary the inclination of the main surface of the feed plate in the feed position depending on the power input of the drive motor of the shredding rotor and/or vary the pressing force of the material against the shredding rotor in the pressing position by setting different angular positions. The control means can also alter the direction of rotation of the shredding rotor and its set speed and thereby pivot the feed plate into the second pressing position.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

BRIEF DESCRIPTION OF THE DRAWING

In the drawing:

FIG. 7 a sectional view of a second exemplary embodiment of the device in the rest position after material has been fed in;

DETAILED DESCRIPTION OF THE INVENTION

1. Basic Construction of the Device

Figure 1:
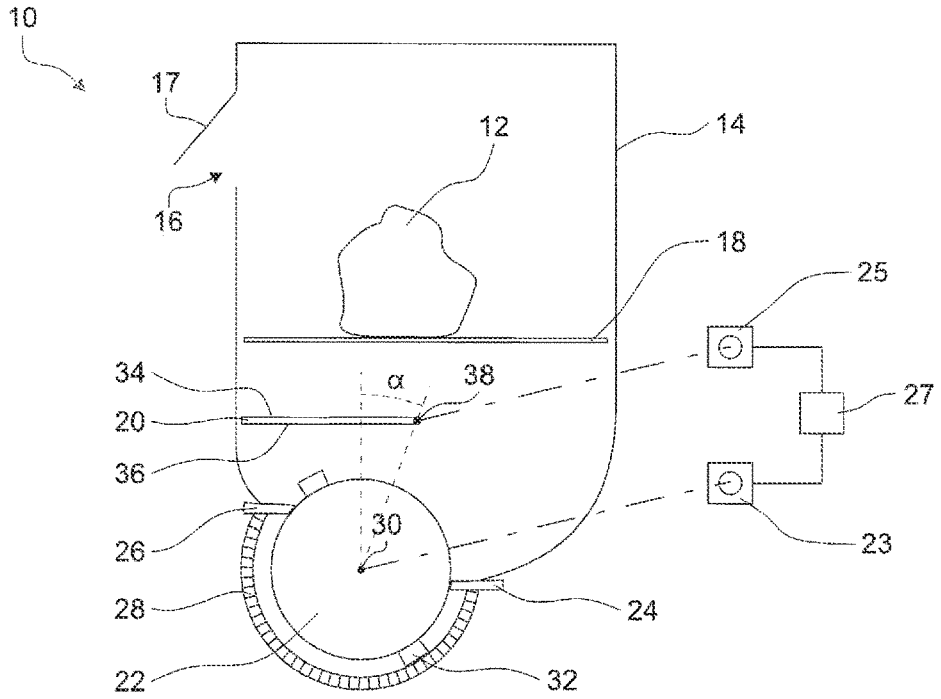
FIG. 1 a sectional view of the device for shredding material in a rest position after material has been fed in by an operator.

In the figures, 10 denotes a device as a whole with which material, in this case medical waste material 12, can be shredded.

Unlike the hitherto conventional method in which medical waste in hospitals is conveyed by cleaning personnel via corridors and lifts to a collecting room in the basement, the device 10 enables it to be shredded on site. The shredded material can then be conveyed via an existing sewage system to the basement, where a wastewater treatment plant removes the material from the waste water and prepares it for final disposal. This considerably reduces the bacterial load on the hospitals.

The device 10 has a housing 14 with a feed opening 16, which can be closed by a lockable flap 17. This enables simple loading from the front or from the side. To close the feed opening 16, it is alternatively possible to provide a displaceable door (not shown specifically) which can be displaced for example between an open and closed position.

Arranged in the interior of the housing 14 are an operator-protection means in the form of a collecting plate 18, a pivotable feed plate 20 and a shredding rotor 22, whereof the axis of rotation 30 is arranged perpendicularly to the plane of projection of the figures. Although the feed opening 16 is shown to the side here with respect to the axis of rotation 30 of the shredding rotor 22, it can also be arranged on a side of the housing 14 which is perpendicular to the shredding rotor 22, depending on the spatial requirements.

The shredding rotor 22 has a substantially cylindrical form and is driven by a drive motor 23, which is only illustrated schematically in FIG. 1.

The shredding rotor 22 supports blades 32 which project in the radial direction. These cooperate with a first counter-blade 24, which is arranged horizontally here, somewhat below the axis of rotation 30, on the circumference of the shredding rotor 22 and therefore substantially radially to the axis of rotation 30 of the shredding rotor 22.

A second counter-blade 26 is offset through approximately 160° relative to the circumference, i.e. it is likewise arranged horizontally here, somewhat above the axis of rotation 30, as a result of which the second counter-blade 26 is not aligned radially to the axis of rotation 30.

The shredding rotor 22 is delimited in a lower circumferential region between the first counter-blade 24 and the second counter-blade 26 by a perforated screen 28, which is at a radial spacing from the shredding rotor 22 and, with this, forms a circumferential gap in which the blade 32 can still pass between the shredding rotor 22 and the perforated screen 28.

The medical waste material 12 can be fed to the shredding rotor 22 in the upper, free circumferential region between the counter-blades 24, 26.

Upon a rotation about the axis of rotation 30, the blades 32 are in contact with the first counter-blade 24 and the second counter-blade 26 and shred the fed-in medical waste material 12 in such a way that this can fall through the perforated screen 28.

The feed plate 20 is arranged above the shredding rotor 22. The feed plate 20 has a first main surface 34 and a second main surface 36 and is mounted such that it is rotatable about a pivot axis 38 extending substantially parallel to the main surfaces 34 and 36. The pivot axis 38 is furthermore arranged substantially parallel to the axis of rotation 30 of the shredding rotor 22.

The feed plate 20 is actively connected in a manner not shown in more detail to an actuator 25 (likewise only shown in FIG. 1) which can be used to vary the angular position of the feed plate 20 about the pivot axis 38. The pivoting range 21 (cf. FIG. 2) of the feed plate 20 covers at least 200° above the shredding rotor 22 here. The actuator 25 can be an electric motor.

Both the drive motor 23 and the actuator 25 are connected to a control means 27 which initiates the different operating modes.

Figure 7:
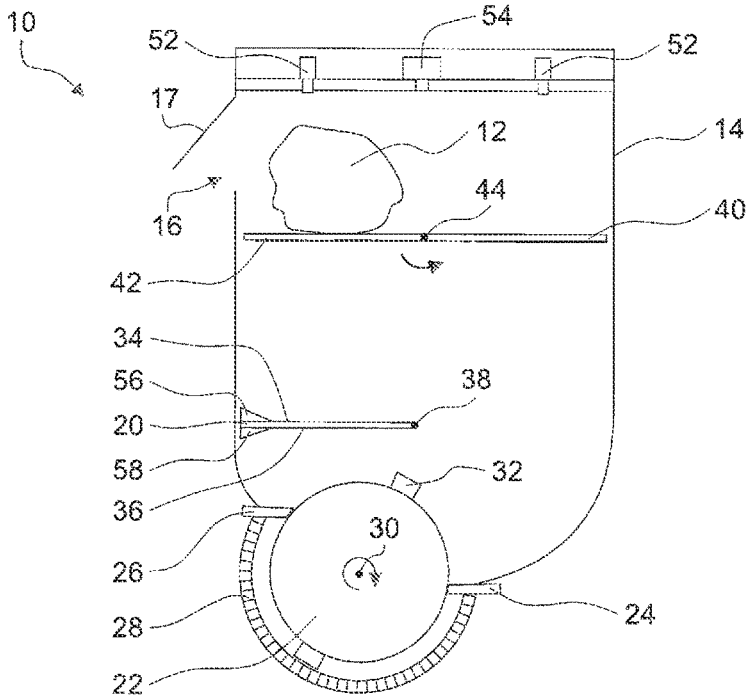
Figure 8:
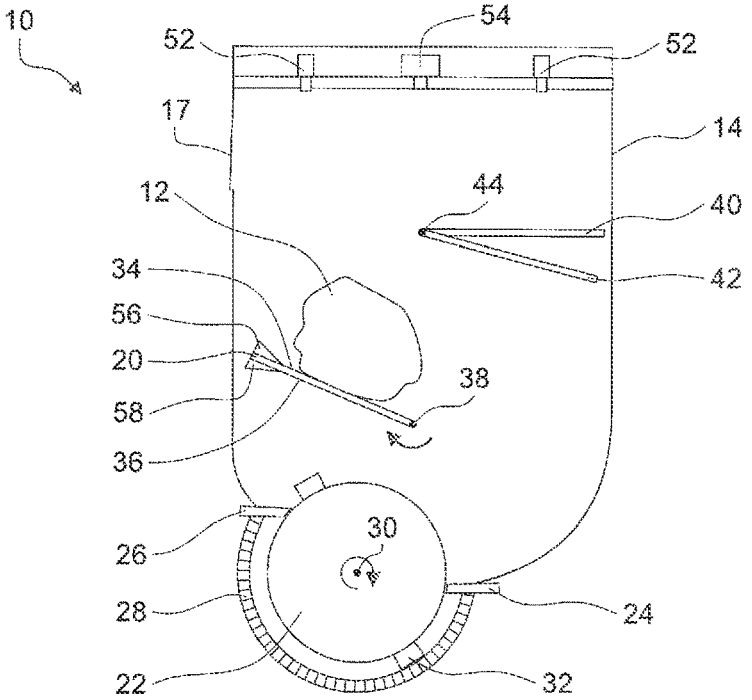
FIG. 8 a sectional view of the second exemplary embodiment of the device in the feed position.

In a further exemplary embodiment, instead of the collecting plate 18, a two-part collecting means 40 is provided, which comprises two collecting flaps 42 as shown in FIGS. 7 and 8.

2. Mode of Operation of the Device

In the rest position shown in FIG. 1, the collecting plate 18 of the operator-protection means is arranged between the feed opening 16 and the feed plate 20 and is arrested in a substantially horizontal position in which the collecting plate 18 extends substantially to the housing walls and therefore covers the shredding rotor 22. A safety circuit ensures here that the lockable flap 17 on the feed opening 16 of the device 10 can only be opened if the collecting plate 18 is in this covering position. The collecting plate 18 therefore prevents any engagement on the part of the operating personnel and, at the same time, serves as a support for the medical waste material 12 fed through the feed opening 16 of the device 10.

In particular, the collecting plate 18, which is not provided in previously known shredding machines, makes it possible to dispense with providing a circumferential protective wall above the shredding rotor 22. This protective wall normally has a minimum height which is greater than an arm's length of the operator and therefore constitutes a passive operator-protection means. Conventional shredding machines therefore always have to be filled from above and are built high, which means that they can only be used on factory floors. The use of the collecting plate 18 therefore enables their use in normal spaces, such as in hospital rooms.

FIG. 1 shows a first exemplary embodiment of the device 10 in a rest position. Medical waste material 12 is fed to the device through the feed opening 16. This waste material lies on the collecting plate 18 which, in the present exemplary embodiment, is mounted horizontally above the feed plate 20. The collecting plate 18 is brought with a pivotal movement into a vertical storage position, in which it remains during the shredding process. With this, the medical waste material 12 falls onto the first main surface 34 of the feed plate 20, as shown in FIG. 2.

Figure 2:
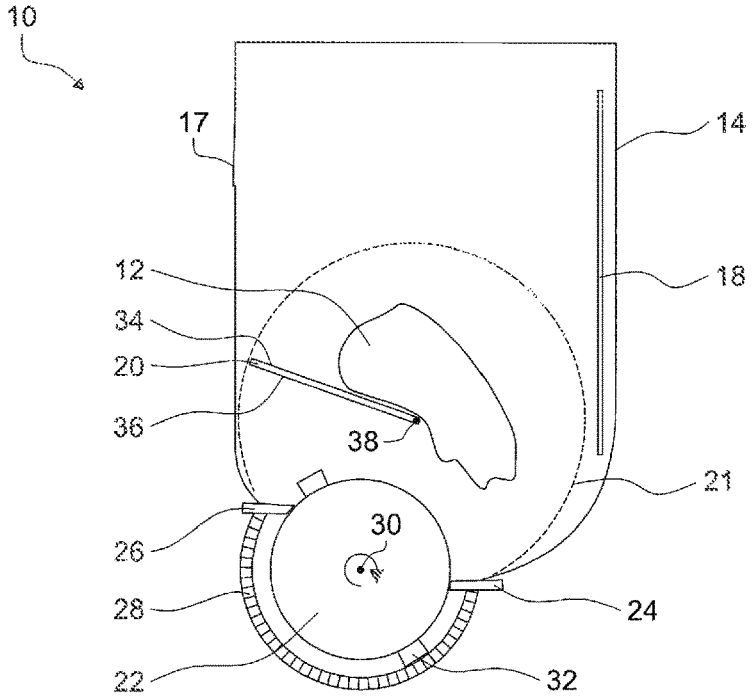
FIG. 2 a sectional view of the device at a later point in a feed position.

The shredding rotor 22 is then set in rotation (clockwise in FIG. 2). The feed plate 20 is rotated gradually clockwise about the pivot axis 38 out of its horizontal rest position. Provided that the collecting plate 18 has reached its storage position, the medical waste material 12 thereby slides along the first main surface 34 and is fed to the shredding rotor 22 as required.

With this, the medical waste material 12 comes into contact with the blades 32 of the shredding rotor 22, is carried along and chopped into relatively small pieces at the latest at the first counter-blade 24. Once the relatively small pieces have reached a particular minimum size, they can fall through the perforated screen and be disposed of.

The control means 27 monitors the speed and power input of the drive motor 23 and ensures that the inclination of the feed plate 20 is adapted accordingly to prevent too great a power input or a blockage of the shredding rotor 22.

Figure 3:
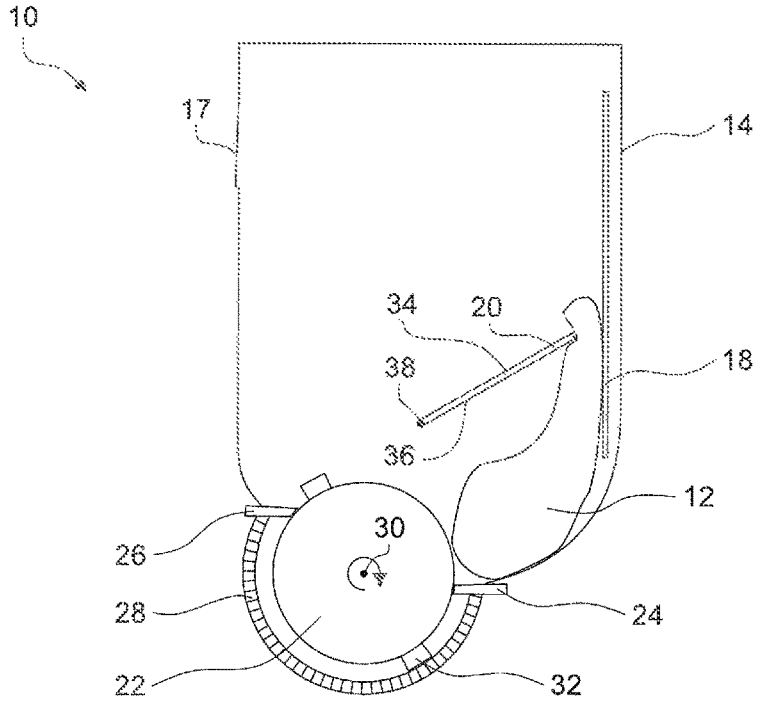
FIG. 3 a sectional view of the device at a later point, in which the feed plate presses the fed-in material against the shredding rotor.

A further metering functionality of the feed plate 20 can also be achieved in that the waste material 12 to be shredded is purposefully trapped between the housing 14 and the feed plate 20, as shown in FIG. 3. This can be especially relevant if the waste material 12 is fed in in sacks or the like.

To this end, starting from the horizontal rest position, the feed plate 20 is pivoted round in such a way that the waste material 12 to be shredded lies on the shredding rotor 22. By pivoting the feed plate further 20, the waste material 12, or the sack in which this is located, is trapped between the feed plate 20 and a housing wall or—as in FIG. 3—the collecting plate 18.

Through an alternating change in the direction of rotation of the feed plate 20, material which is trapped in this way can be released and trapped again so that it is fed to the shredding rotor 22 as required.

If, as the material 12 is shredded, the weight force alone is not sufficient to achieve efficient shredding, the material 12 can be pressed against the shredding rotor 22. If an increased power input is determined, then the pressure force is reduced or removed.

Figure 4:
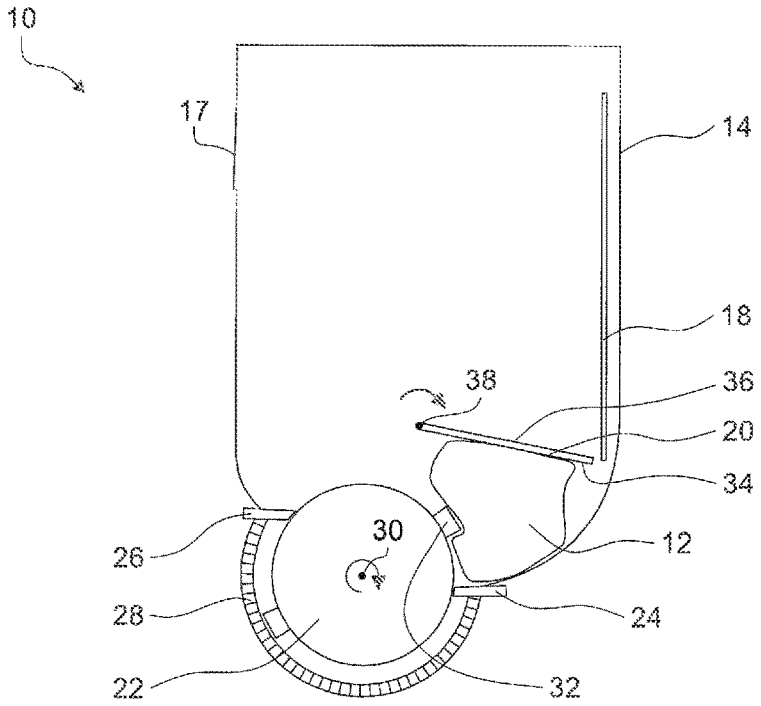
FIG. 4 a sectional view of the device at a later point after a change in the direction of rotation of the shredding rotor.

FIG. 4 shows how the feed plate 20 is used as a pressing means for this purpose.

The control means 27 firstly pivots the feed plate 20 out of the feed position, in which the waste material 12 lies substantially on the first main surface 34, into the first pressing position, in which the feed plate 20 presses substantially from above on the waste material 12 with the first main surface 34 in FIG. 4.

To ensure better contact of the medical waste material 12 with the shredding rotor 22, a pressure force is exerted here by the feed plate 20 on the medical waste material 12, said pressure force being directed substantially perpendicularly to the first main surface 34. The less medical waste material 12 there is between the feed plate 20 and the shredding rotor 22, the greater the force component acting in the radial direction to the shredding rotor. The feed of the medical waste material 12 is further facilitated in that the housing 14 has curved walls in the vicinity of the shredding rotor 22, with these tapering substantially radially with respect to the shredding rotor.

Figure 5:
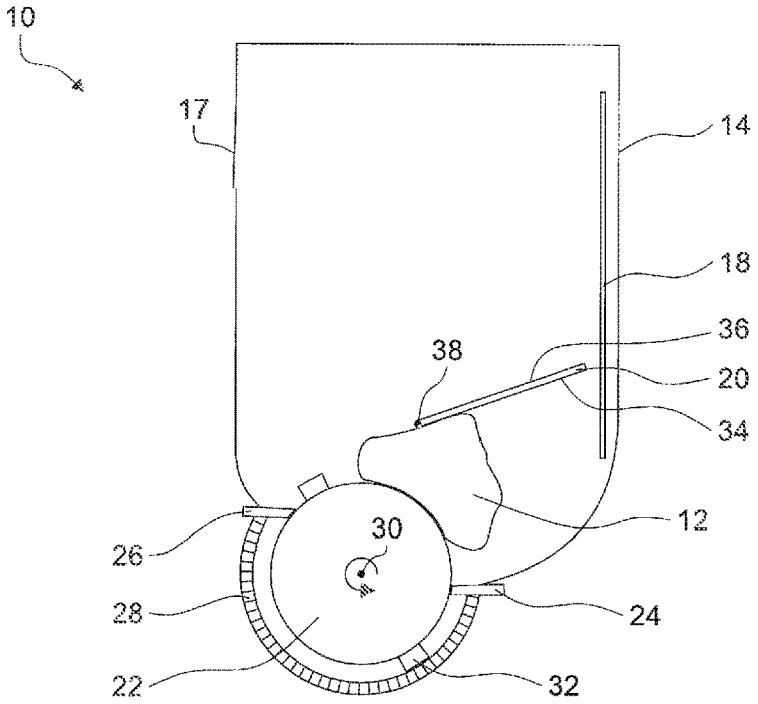
FIG. 5 a sectional view of the device in a second pressing position.

To devise the shredding process more efficiently, the present exemplary embodiment also provides for the shredding rotor 22 to be operated in both directions. This is shown in FIG. 5, in which the shredding rotor 22 is shown running counter-clockwise.

The blades 32 on the shredding rotor 22 are constructed with double cutting edges for this. The pivot axis 38 and the axis of rotation 30 form a plane which divides the housing into two sub-regions. As a result of the change in direction of the shredding rotor 22, the medical waste material 12 arrives from the first sub-region, in which the first counter-blade 24 is located, into the second sub-region, in which the second counter-blade 26 is located.

The shredding rotor 22 in the present exemplary embodiment is arranged eccentrically on the housing 14 so that the plane formed by the pivot axis 38 and the axis of rotation 30 forms an angle $\alpha$ with the vertical. This enables an asymmetrical construction of the device 10 with respect to the plane, resulting in the two sub-regions having a geometrically unequal design. This generates a different feed behaviour of the waste material 12 in relation to the respective housing wall and counter-blade 24, 26, which can contribute to a more efficient shredding process.

As a result of the pivot axis 38 of the feed plate 20 and the axis of rotation 30 of the shredding rotor 22 being at a spacing from one another which is greater than the radius of the shredding rotor 22, a passageway is formed between the cylindrical shredding rotor 22 and the pivot axis 38. The medical waste material 12 is then carried along by the shredding rotor 22 and fed to the second counter-blade 26 through the passageway. If the pressure force of the feed plate 20 is removed and the feed plate 20 is pivoted in a counter-clockwise direction and locked in an intermediate position, the feed plate 20 forms a funnel together with the surface of the shredding rotor 22. The medical waste material 12 slides therein along the first main surface 34 of the feed plate 20. Alternatively, the funnel function can however also be achieved by simply removing the pressure force in the first pressing position of the feed plate 20 without this needing to be locked in a defined intermediate position.

Figure 6:
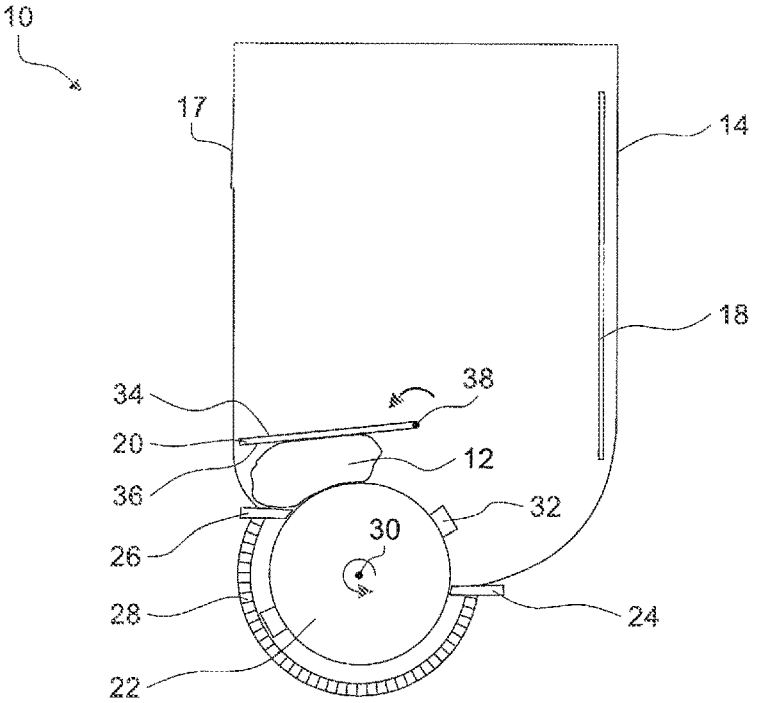
FIG. 6 a sectional view of the device after a second change in direction of the shredding rotor.

As soon as the medical waste material 12 has been transferred into the second sub-region of the device, the feed plate 20 is pivoted in the counter-clockwise direction until it can press with its second main surface 36 against the medical waste material 12, as shown in FIG. 6. The pressure force here acts perpendicularly to the second main surface 36 of the feed plate 20.

The forces acting on the medical waste material 12 can result in an undesired compression of the medical waste material 12 during operation. To loosen this, provision is made in a further step for the direction of rotation of the shredding rotor 22 to change again. The feed plate 20 again cooperates with the surface of the shredding rotor 22 in the manner of a funnel, with the second main surface 36 here serving as a guide element for the medical waste material 12.

The medical waste material 12 is thus transferred from the second sub-region back into the first sub-region of the device 10. To accelerate the shredding process, the feed plate 20 is brought into its first pressing position.

During operation, the change in the direction of rotation can take place a plurality of times, in which case the time at which such a change is introduced can be determined by the control means 27, for example as a result of an increase in the load torque on the drive motor 23 of the shredding rotor 22. Such an increase in the load torque can signify a compression of the medical waste material 12.

3. Modifications

In a further exemplary embodiment, the operator-protection means is formed by two collecting flaps 40, 42 arranged horizontally in their rest position, as shown in FIGS. 7 and 8. The collecting flaps 40, 42 are pivotably mounted on a common axis 44, which extends substantially parallel to the axis of rotation 30 and the pivot axis 38. In this case, the spacing between the axis 44 and the pivot axis 38 is at least as great as the length of the feed plate 20, so that this latter can be pivoted unhindered between its first pressing position and its second pressing position.

To enable the feed of medical waste material 12, a collecting flap 42 is opened in that it is pivoted in a downward direction. If the collecting flap 42 has been pivoted further and moved out of the pivoting range of the feed plate 20, the medical waste material 12 can be fed to the shredding rotor 22, as shown in FIG. 8.

When, in the next step, the feed plate 20 has reached the first pressing position, the open collecting flap 42 can be pivoted back into its rest position. The collecting means can therefore also fulfil its safety function during operation.

In a further modification of the device 10 according to the invention, it is possible to dispense with a collecting plate 18 or with collecting flaps 40, 42. So that an operator-protection function is still ensured, the open position of the lockable flap 17 can only be achieved in this case when the shredding rotor 22 is not moving. Electrical and/or mechanical monitoring means can be provided for this, which form the operator-protection means in conjunction with the lockable flap 17. In the exemplary embodiments described, material is then fed in during operation preferably when the feed plate 20 is located in its feed position. This enables a metering of the medical waste material 12 to be shredded.

As likewise shown in FIGS. 7 and 8, the device 10 can have an intermediate ceiling 50 above the opening 16. When used for shredding medical waste material 12, nozzles 52 are arranged in this intermediate ceiling and can be used to spray disinfectant and cleaning water into the device 10. This enables the device 10 to be disinfected and rinsed from time to time.

When used to destroy information carriers, a camera 54 which documents the destruction of a particular information carrier can be arranged in the intermediate ceiling 50.

As a further modification, in FIGS. 7 and 8 the feed plate 20 is provided with pressing wedges 56 and 58 on both sides at its end which is remote from the pivot axis 38. The pressing wedges 56 and 58 enable the surface of the feed plate 20 which is active during the pressing procedure to advance more closely to the cylindrical shredding rotor 22.

While specific embodiments of the invention have been shown and described in detail to illustrate the inventive principles, it will be understood that the invention may be embodied otherwise without departing from such principles.

I claim:

1. A device for shredding material, comprising:

a) a rotor that revolves about an axis of rotation and supports at least one blade, and b) a first counter-blade, which cooperates with the blade of the rotor; and c) a feed plate rotatable about a pivot axis so that a position of the feed plate about the pivot axis is variable, and wherein d) the pivot axis of the feed plate is arranged with respect to the axis of rotation of the rotor so that the feed plate can be brought into a feed position in which the material to be shredded can lie on a first main surface of the feed plate and can slide along the first main surface in a direction of the rotor, and wherein the feed plate can be brought into a first pressing position, in which the material to be shredded is also pressed with the first main surface of the feed plate against the shredding rotor and is shredded between the blade and the first counter blade, wherein, upon a change in the direction of rotation of the rotor, the feed plate can be brought into a second pressing position in which the material to be shredded is pressed with a second main surface of the feed plate against the rotor and is shredded between the blade and the second counter-blade, wherein the feed plate has a pivoting range of at least 200° about the pivot axis.

2. The device according to claim 1, wherein, in the feed position, the inclination of the first main surface of the feed plate with respect to the horizontal is variable in a range of 5° to 85°.

3. The device according to claim 2, wherein the range is 10° to 45°.

4. The device according to claim 3, wherein the range is 15° to 25°.

5. The device according to claim 1, wherein the axis of rotation of the rotor and the pivot axis of the feed plate define a plane which divides the device into two sub-regions, the first counter-blade being located in a first of the sub-regions and a second counter-blade is located in a second of the sub-regions.

6. The device according to claim 5, wherein the feed plate is mounted at one end so as to be rotatable about the pivot axis.

7. The device according to claim 6, wherein the axis of rotation of the rotor and the pivot axis of the feed plate are spaced from one another so that, upon a change in a direction of rotation of the rotor, the material to be shredded is fed to the second counter-blade.

8. The device according to claim 6, wherein the second counter-blade has a cutting geometry that differs from a cutting geometry of the first counter-blade.

9. The device according to claim 8, wherein the second counter-blade is not arranged along a radius of the rotor.

10. The device according to claim 1, further comprising an actuator provided to rotate the feed plate, and a control that controls the actuator of the feed plate and the shredding rotor so that power input of the rotor does not exceed 3.5 kW.

11. The device according to claim 10, wherein the actuator is an electric motor.

* * * * *